US008469242B2

(12) United States Patent
Kolon et al.

(10) Patent No.: US 8,469,242 B2
(45) Date of Patent: Jun. 25, 2013

(54) DISPENSING DEVICE

(75) Inventors: Philipp Kolon, Oehringen (DE); Bernd Haeussler, Oehringen (DE); Rainer Opferkuch, Hoesbach (DE)

(73) Assignee: HUBER Packaging Group GmbH, Oehringen (DE)

( * ) Notice: Subject to any disclaimer, the term of this patent is extended or adjusted under 35 U.S.C. 154(b) by 418 days.

(21) Appl. No.: 12/778,399

(22) Filed: May 12, 2010

(65) Prior Publication Data

US 2010/0294799 A1 Nov. 25, 2010

Related U.S. Application Data

(63) Continuation of application No. PCT/EP2008/009295, filed on Nov. 5, 2008.

(30) Foreign Application Priority Data

Nov. 13, 2007 (DE) ..... 10 2007 055 466

(51) Int. Cl.
*B67D 3/00* (2006.01)

(52) U.S. Cl.
USPC ..... 222/538; 222/527; 222/529; 222/533

(58) Field of Classification Search
USPC ..... 222/401, 505, 153.01, 400.8, 517, 222/538, 527, 529, 533; 137/317
See application file for complete search history.

(56) References Cited

U.S. PATENT DOCUMENTS 2,083,776 A * 6/1937 Ferguson ..... 222/130
2,134,852 A 11/1938 Bogan
2,514,773 A * 7/1950 Kromer ..... 62/166
5,358,154 A * 10/1994 Halm ..... 222/536
5,392,957 A * 2/1995 Parsons ..... 222/1
6,056,166 A * 5/2000 Schmitz et al. ..... 222/385

(Continued)

FOREIGN PATENT DOCUMENTS

DE 1 782 495 9/1971
DE 201 22 474 U1 10/2005

(Continued)

*Primary Examiner* — Kevin P Shaver
*Assistant Examiner* — Christopher Bahr
(74) *Attorney, Agent, or Firm* — Harness, Dickey & Pierce, P.L.C.

(57) ABSTRACT

Disclosed is a dispensing device for dispensing liquid from a container having a top, a side wall and a bottom, comprising a sleeve which can be inserted into the top in a sealing manner and into which a rising pipe opens via an inflow opening, a piston which is movable in the sleeve and can be moved between a closed position, in which the inflow opening is closed off by the piston, and an opened position, in which the inflow opening is connected to an outlet opening via a cavity of the piston. The outlet opening opens into an outlet channel of an extension arm which protrudes laterally from the sleeve and the output of which is coupled to a dispensing valve which can be activated by means of an actuating member in order to allow, in the opened position, liquid to be dispensed. The extension arm with the dispensing valve is, in the closed position, completely recessed within an outwardly open recess between the top and an outer edge of the container and can be transferred by way of a movement of the piston into a dispensing position in which a dispensing opening protrudes outwards beyond the outer edge of the container.

20 Claims, 8 Drawing Sheets

U.S. PATENT DOCUMENTS

| | | | | |
|---|---|---|---|---|
| 6,745,922 | B1 * | 6/2004 | Vlooswijk et al. | 222/399 |
| 6,851,585 | B2 * | 2/2005 | Wrigley | 222/505 |
| 6,920,893 | B2 * | 7/2005 | Rokkjaer | 137/322 |
| 7,168,683 | B2 * | 1/2007 | Pliml, Jr. | 251/353 |
| 7,533,788 | B2 * | 5/2009 | Harvey et al. | 222/509 |
| 7,584,873 | B2 * | 9/2009 | Grittmann | 222/399 |
| 7,721,921 | B2 * | 5/2010 | Ramusch et al. | 222/505 |
| 7,815,078 | B2 * | 10/2010 | Robinson | 222/509 |
| 7,866,510 | B2 * | 1/2011 | Schneider et al. | 222/153.06 |
| 8,070,023 | B2 * | 12/2011 | Vitantonio et al. | 222/399 |
| 2004/0118708 | A1 * | 6/2004 | Magermans et al. | 206/217 |
| 2006/0243754 | A1 * | 11/2006 | Rackwitz | 222/402.15 |
| 2009/0302069 | A1 | 12/2009 | Oberhofer et al. | |

FOREIGN PATENT DOCUMENTS

| | | | |
|---|---|---|---|
| EP | 0 963 944 | A1 | 12/1999 |
| EP | 1 642 861 | A1 | 4/2006 |
| NL | 1032890 | | 5/2008 |
| WO | WO 99/31010 | | 6/1999 |
| WO | WO 2005/007560 | A2 | 1/2005 |
| WO | WO 2007/145641 | A1 | 12/2007 |

* cited by examiner

DISPENSING DEVICE

CROSS-REFERENCES TO RELATED APPLICATIONS

This application is a continuation of International Patent Application PCT/EP2008/009295, filed on Nov. 5, 2008 designating the U.S., which International Patent Application has been published in German language and claims priority from German patent application 10 2007 055 466.6, filed on Nov. 13, 2007. The entire contents of these priority applications are incorporated herein by reference.

BACKGROUND OF THE INVENTION

The invention relates to a dispensing device for dispensing liquid from a container which has a top, a bottom and a side wall and on the bottom of which a dispensing device, by means of which liquid can be dispensed in a convenient manner from the container, is accommodated.

Various dispensing devices are known in the art for what are known as party kegs which usually have a filling volume of 5 or 10 liters and are generally filled with beer.

A simple solution is a dispensing tap which is attached laterally to the bottom of the body of the keg and through which the beverage can be removed. In this case, the liquid is removed from the container as a result of the inherent gravity pressure (cf. WO 99/31010). However, this requires an additional opening for the compensation of pressure in the container, as otherwise the reduced pressure produced in the container would prevent liquid from running out. The pressure compensation, which is thus produced as a result of ambient air flowing in, soon leads to a loss of quality in carbonated beverages or beverages which are sensitive to oxidation.

In order to avoid this drawback, the container can be placed under a constant internal pressure which is independent of the filling level (cf. for example EP 1 642 861 A1 and WO 2005/007560 A2). In this case, the internal pressure prevailing in the container allows the position of the dispensing tap on the container to be freely selected.

These solutions have the drawback of an arrangement of the dispensing device that is provided on the upper side of the container, as this makes the containers less easy to stack.

Although it is also known in the art to accommodate the dispensing device submerged between the top of the container and the peripheral outer edge (cf. U.S. Pat. No. 2,134,852), the known solution is very costly and complex.

SUMMARY OF THE INVENTION

In view of this it is a first object of the present invention to disclose a dispensing device for dispensing liquid from a container which provides a simple and easy construction.

It is a second object of the present invention to disclose a dispensing device for dispensing liquid from a container which is constructed in a cost-effective way.

It is a third object of the present invention to disclose a dispensing device for dispensing liquid from a container that is easy to operate and does not adversely affect the handling of the container.

These and other objects of the invention are achieved by a dispensing device for dispensing liquid from a container comprising a top, a bottom and a side wall, a sleeve which can be inserted into the top in a sealing manner and into which a rising pipe opens via a dispensing opening, a piston which is movable in the sleeve and can be moved between a closed position, in which the inflow opening is closed off by the piston, and an opened position, in which the inflow opening is connected to an outlet opening via a cavity of the piston, wherein the outlet opening opens into an outlet channel of an extension arm which protrudes laterally from the sleeve and the output of which is coupled to a dispensing valve which can be activated by means of an actuating member in order to allow, in the opened position, liquid to be dispensed, wherein the extension arm with the dispensing valve is accommodated, in the closed position, so as to be completely submerged within an outwardly open recess between the top and an outer edge of the container and can be transferred by way of a movement of the piston into a dispensing position in which a dispensing opening protrudes outwards beyond the outer edge of the container.

The objects of the invention are perfectly achieved in this way.

As a result of the configuration of the dispensing device with a piston which may be withdrawn from a sleeve, it is possible to achieve, in conjunction with the geometrical configuration of the extension arm, that the dispensing valve is accommodated, in the closed position, so as to be completely submerged within an outwardly open recess between the top and an outer edge of the container and in the dispensing position protrudes outwards beyond the outer edge of the container.

Thus, on the one hand, stackability of the containers is ensured and, on the other hand, convenient dispensing is allowed when the dispensing valve is in its opened position.

According to a further feature of the invention, the piston is movable between the closed position and the opened position by way of an axial displacement and/or a rotation within the sleeve.

In this way, a sealing of the dispensing device in the still closed-off original state can be achieved using particularly simple means, even higher pressures of about 5 bar, for example, being possible within the container in the still closed-off original state without jeopardizing the secure seal.

According to a further feature of the invention, guide element are provided that define an axial displacement and a rotation of the piston between the closed position and the opened position.

These features make the transfer of the dispensing device from the closed position to the opened position clearly discernible to the user and prevent accidental setting of the opened position.

According to a further configuration of the invention, a handle is provided on the piston for withdrawing the piston from the closed position.

This facilitates the transfer of the dispensing device into the opened position.

According to a further embodiment of the invention, the extension aim consists of two parts which can be securely connected to each other and have, on their mutually facing joining faces, depressions which jointly form the outlet channel.

A configuration of this type allows the extension arm to be manufactured as a plastic injection-molded part, wherein the outlet channel can have a broadly variable shape.

Preferably, the outlet channel is in this case curved.

According to a further configuration of the invention, the dispensing opening is formed in a side wall of the sleeve, and the piston has an inlet opening which is aligned with the inflow opening in the opened position.

In this way, a simple and secure sealing can be achieved both in the closed position and in the opened position.

According to a preferred development of the invention, the dispensing valve is designed as a roller valve.

This provides a particularly simple construction and easy activatability with the aid of an associated actuating member.

The actuating member is preferably embodied as a pivoted lever which is pivotably secured to the extension arm.

This provides a particularly simple possibility for actuation.

According to a further configuration of the invention, a tamper-evident element is provided that indicates whether the dispensing device in the closed position is in the still intact original state.

In this case, the tamper-evident element can be formed by a tear-off plastic web or a tear-off plastic tab, for example.

A tamper-evident element of this type ensures that a non-authorised first-time opening and transfer of the dispensing device to the opened position is made visually discernible to a customer or consumer.

In a further configuration of the invention, the dispensing device consists of plastic injection-molded parts.

This allows simple and cost-effective manufacture in large quantities.

In an additional development of the invention, a sealing face, which is molded on using 2-component technology, is provided on one of the plastic injection-molded parts.

In 2-component technology, two different plastics materials having different properties, for example a harder material and a softer material, are joined together in successive injection-molding processes. This produces a particularly intimate and effectively adhering connection between the two plastics materials.

This ensures a simple and reliably sealing embodiment of the sealing faces in question.

According to a further configuration of the invention, a restriction is provided for limiting the exit speed. The restriction may be a reduction in cross section over a relatively large region or a locally limited reduction in cross section that is provided in the rising pipe or in the outlet channel, for example.

It is thus possible to limit the exit speed to a desired range.

It goes without saying that features of the invention that have been mentioned hereinbefore and will be described hereinafter can be used not only in the respectively specified combination, but also in other combinations or in isolation without departing from the scope of the invention.

BRIEF DESCRIPTION OF THE DRAWINGS

Further features and advantages of the invention will become apparent from the description that follows of preferred embodiments, with reference to the drawings. In the drawings.

DESCRIPTION OF PREFERRED EMBODIMENTS

Figure 1:
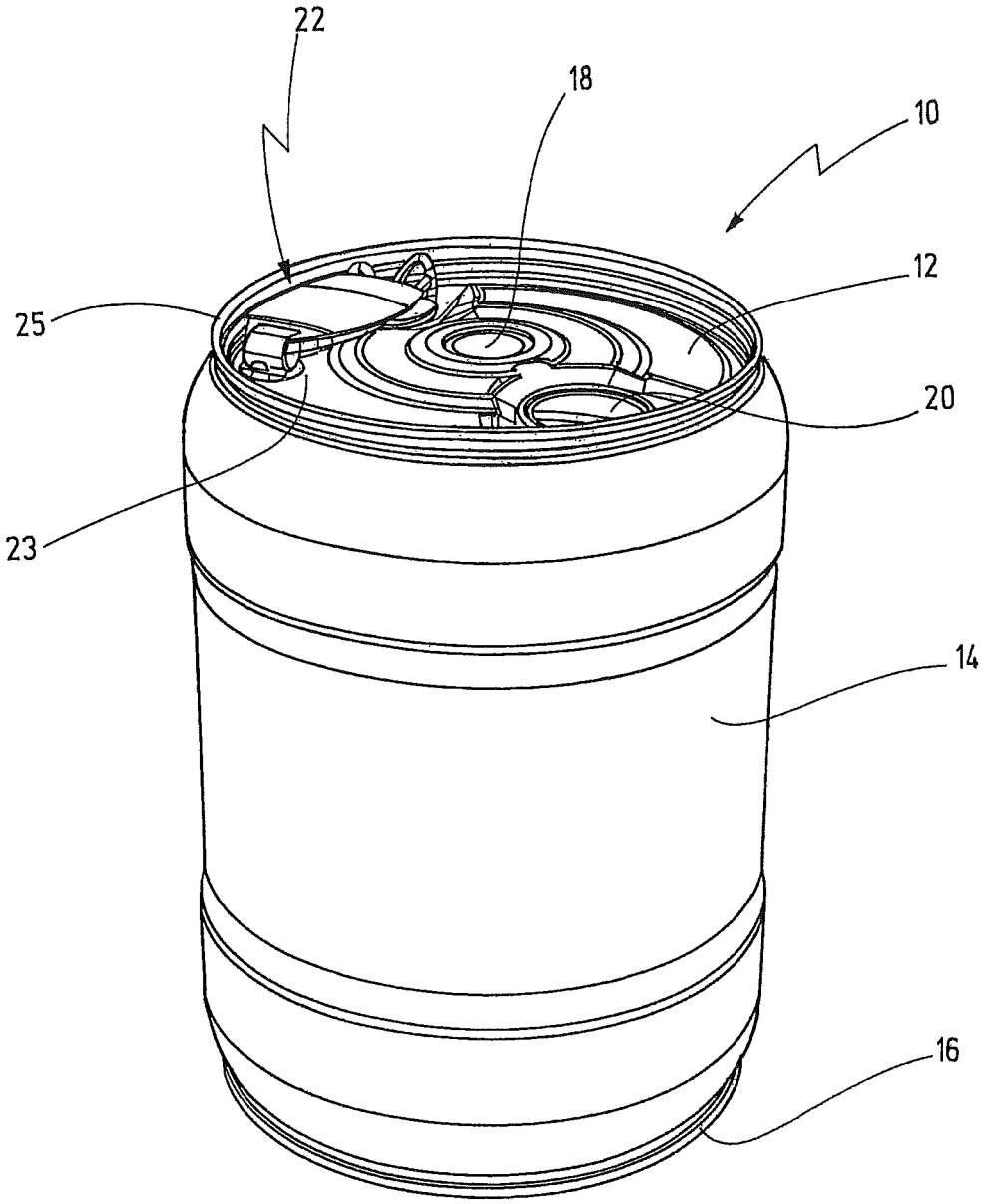
FIG. 1 is a perspective view of a container in the form of a party keg with a dispensing device according to the invention in the closed position in the original state of the dispensing device.

FIG. 1 is a perspective illustration of a container 10 in the form of a party keg which has a capacity of 5 liters, for example, and is denoted in its entirety by 10. The container 10 has a substantially cylindrical basic shape with a top 12, a side wall 14 and a bottom 16. A central filling opening 18, which allows the container 10 to be filled with a beverage, for example with beer, is provided at the top 12. On the top 12 also an opening 20 is provided, into which a pressure cartridge with a controller can be inserted in order to permanently apply gas pressure, for example a CO2 gas pressure, to the interior of the container, which is in principle known in the art, such as from US 2009/0302069 A1 which is fully incorporated by reference herewith.

A dispensing device according to the invention, which is denoted overall by 22, is also accommodated on the top 12. In the position shown in FIG. 1, the dispensing device 22 is in a completely submerged arrangement within an outwardly open recess 23 formed between the top 12 and the peripheral outer edge 25. The dispensing device 22 thus does not protrude upwards beyond the contour of the outer edge 25. The container 10 can thus be stacked despite the built-in dispensing device 22.

Figure 2:
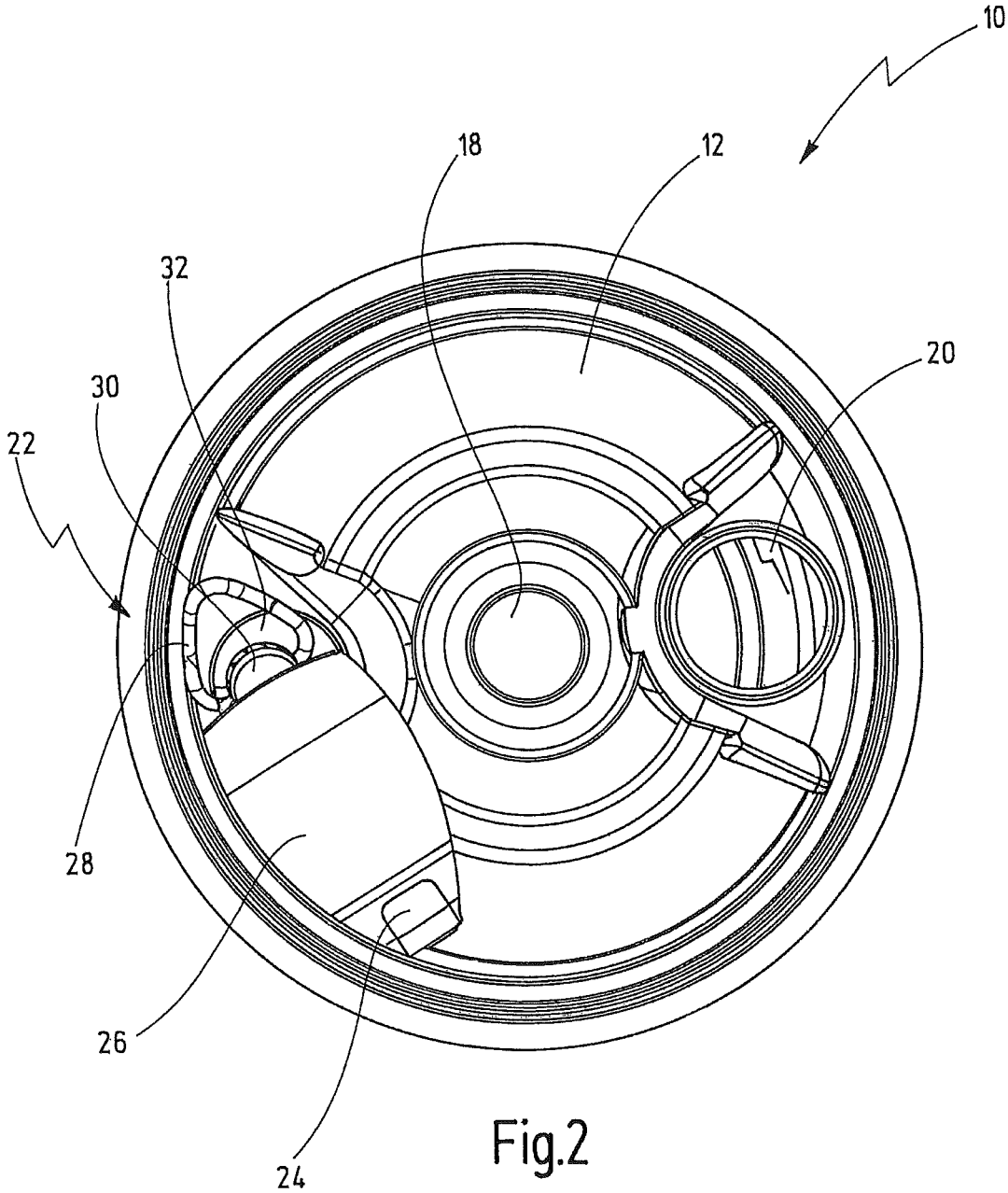
FIG. 2 is an enlarged plan view of the container according to FIG. 1 from above.

Further details of the dispensing device 22 may be seen from the enlarged plan view according to FIG. 2. The dispensing device 22 has a dispensing valve 24 which can be activated by means of an actuating member 26. A piston 30, which protrudes upwards from a sealing flange 32 which is inserted in a sealing manner into a corresponding opening on the top 12, may also be seen as a further part of the dispensing device 22.

Figure 3:
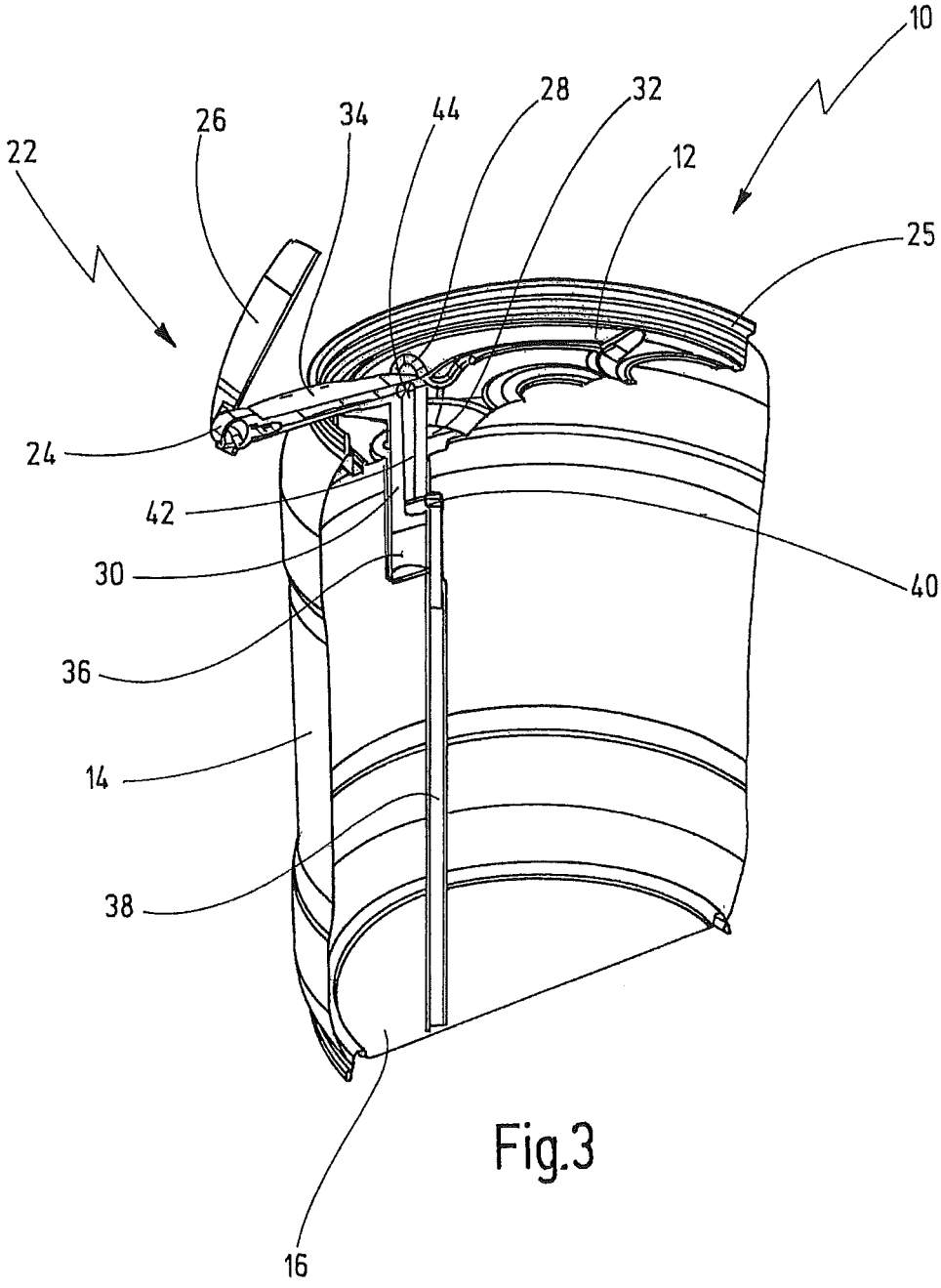
FIG. 3 is a partially cut-away illustration of the container according to FIG. 1, the dispensing device being in its opened position in which a dispensing process is possible.

The basic construction of the dispensing device 22 may be seen in greater detail from FIG. 3.

The dispensing device 22 has a sleeve 36, with the upper end of which the sealing flange 32 is integrally molded. The piston 30 is arranged in the sleeve 36 so as to be axially displaceable and additionally rotatable by a certain amount. A rising pipe 38, which opens into the interior of the sleeve 36 via an inflow opening 40, is arranged laterally on the sleeve 36. In the position illustrated in FIG. 3, the piston 30, which is axially displaceable and additionally rotatable in the sleeve 36, produces a connection from the inflow opening 40 via a cavity 42 formed in the piston 30 to an outlet opening 44 at the piston end, the outlet opening being adjoined by an outlet channel which is formed in an extension arm 34 and finally opens into the dispensing valve 24.

In the opened position shown in FIG. 3, a connection from the rising pipe 38 up to the dispensing valve 24 is therefore produced via the piston 30.

If, on the other hand, the dispensing device 22 is in its closed position, then the inflow opening 40 is securely closed off by the piston 30.

Figure 4:
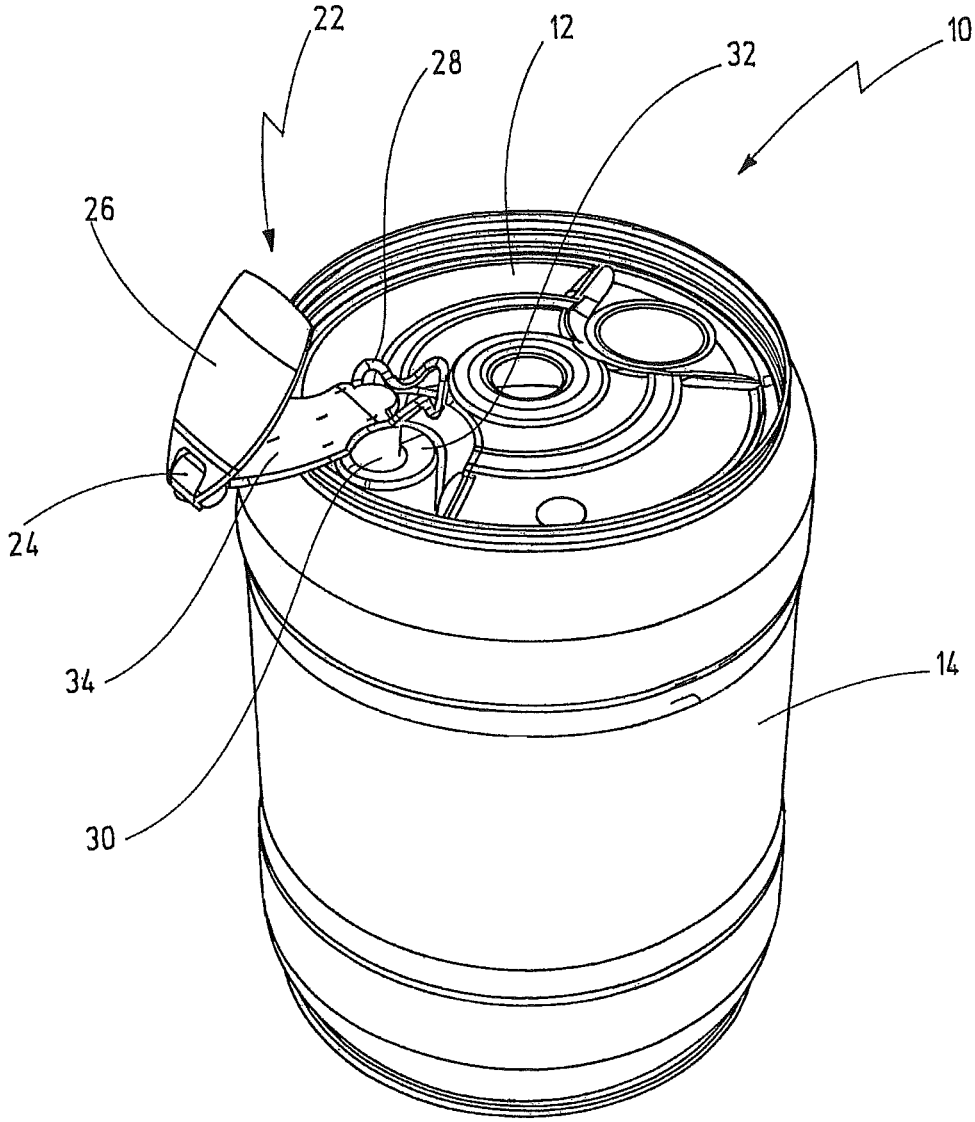
FIG. 4 is a plan view onto the container according to FIG. 3 obliquely from the front.

An enlarged illustration of the container 10 in FIG. 4 shows the dispensing device 22 likewise in its opened position in which the extension aim 34 is pivoted outwards into a use position, wherein liquid can issue outward from the interior of the container on actuation of the dispensing valve 24 by means of the actuating member 26.

In order to facilitate a transfer of the dispensing device 22 from the closed position, in which the dispensing device 22 is submerged on the bottom 12, a handle 28 is provided on the piston 30. The handle 28 can have any desired shape which is in any case configured in such a way as to allow simple gripping and withdrawal of the piston 30 upwards.

Figure 5:
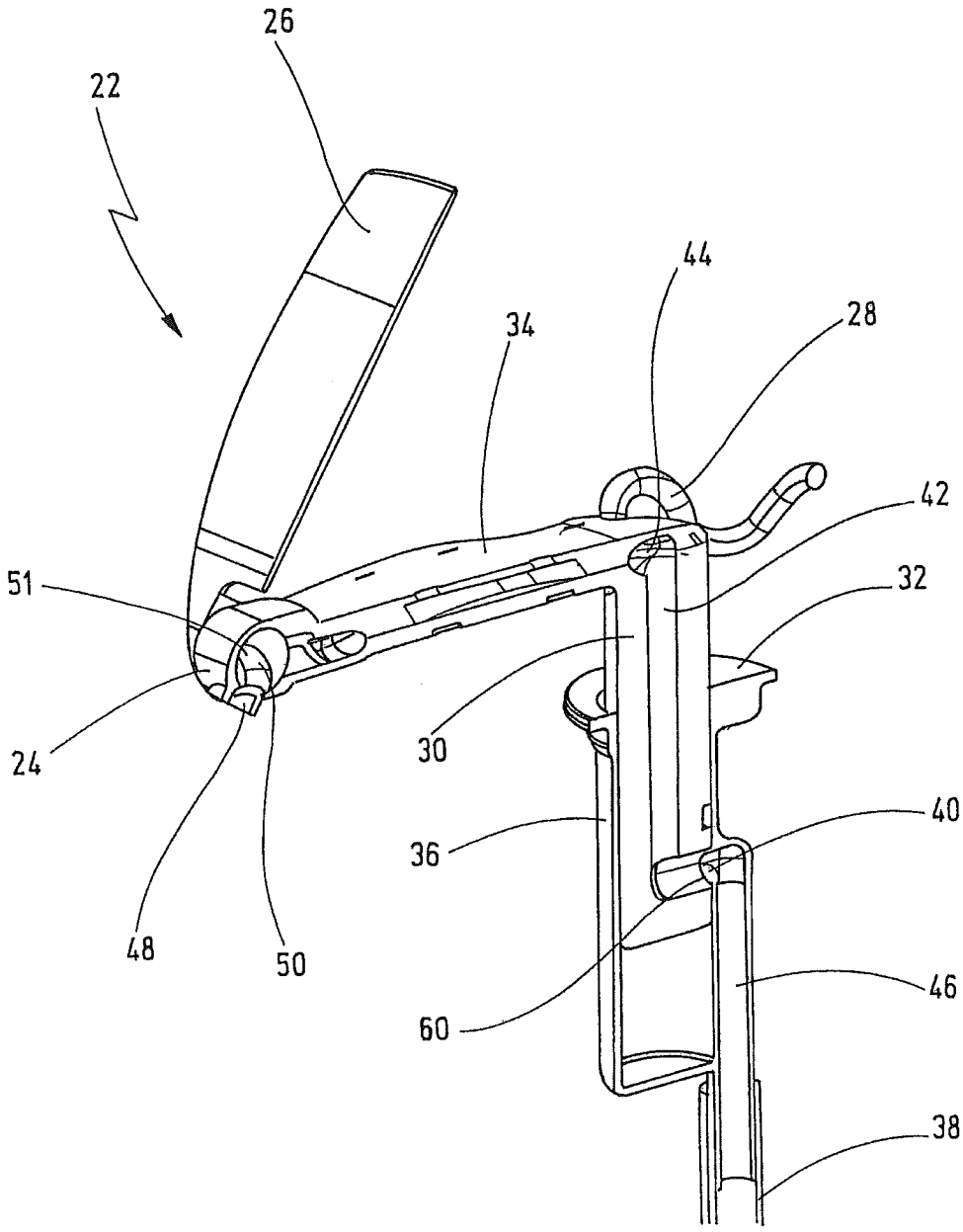
FIG. 5 is an enlarged, partially cut-away illustration of the dispensing device.

The interacting of the piston 30 and sleeve 36 may be seen more clearly from the enlarged, partially cut-away illustration according to FIG. 5.

The sleeve 36 has a basically cylindrical shape and is closed on its end face at the lower end, whereas the sealing flange 32, which is made of relatively soft plastics sealing material, is molded integrally with the upper end. The piston 30 is accommodated in an axially displaceable and rotatable manner within the sleeve 36. A connection piece 46 is flanged laterally onto the sleeve 36 for accommodating the rising pipe 38. The connection piece 46 opens into the interior of the sleeve 36 via the inflow opening 40. In the opened position shown in FIG. 5, the inflow opening 40 of the sleeve 36 corresponds to an associated piston inlet 60 which opens into the cavity 42 of the piston 30, thus producing a throughflow channel to the outer end of the piston 30 that opens into the outlet opening 44.

Figure 6:
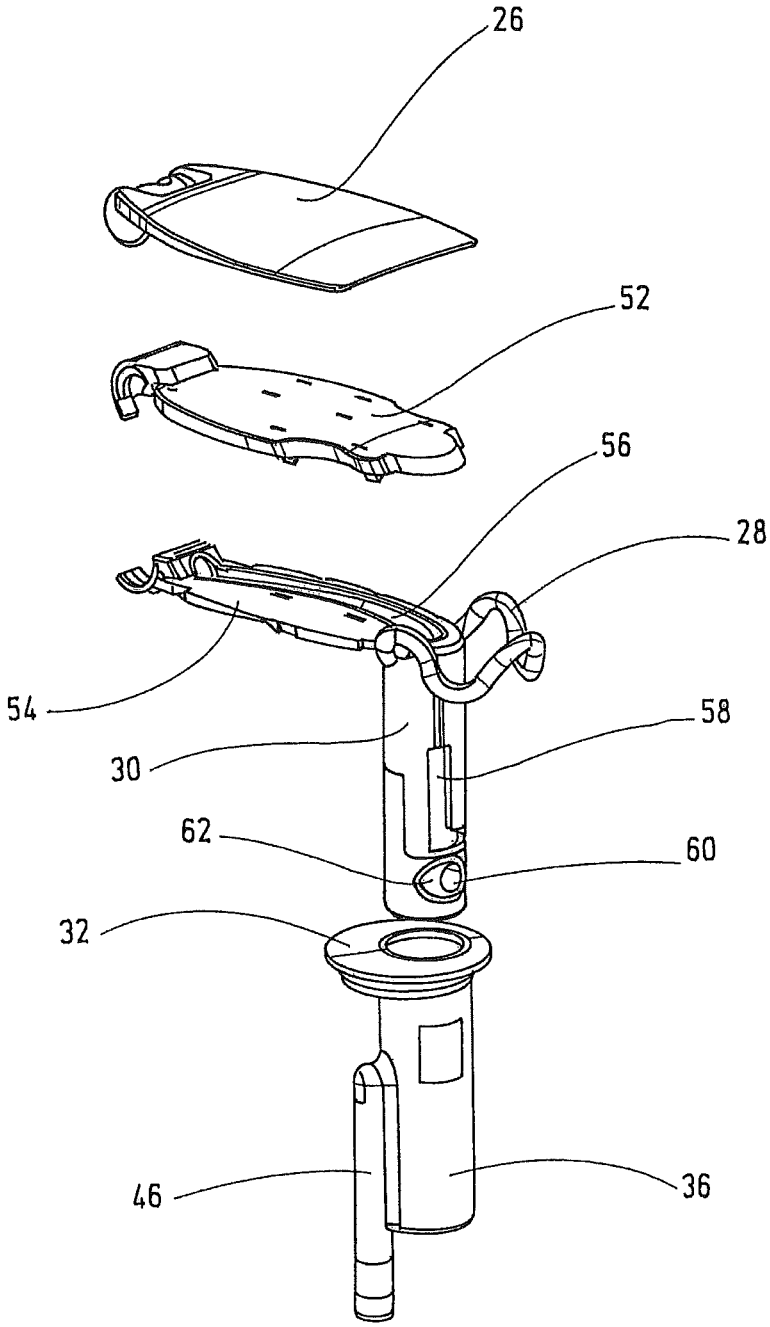
FIG. 6 is an exploded illustration of the dispensing device with the sleeve, the piston arranged thereabove with the extension arm, the upper part arranged thereabove of the extension arm and an actuating member arranged thereabove.

FIG. 6 shows that there is provided on the outer surface of the piston 30 a guide element 58 in the foam of a groove with which an associated counter-guide element (not shown) on the inner surface of the sleeve 36 engages. This forms a restricted guide, so that the piston 30 is axially displaceable by a certain amount and rotatable by a certain amount within the sleeve.

Figure 7:
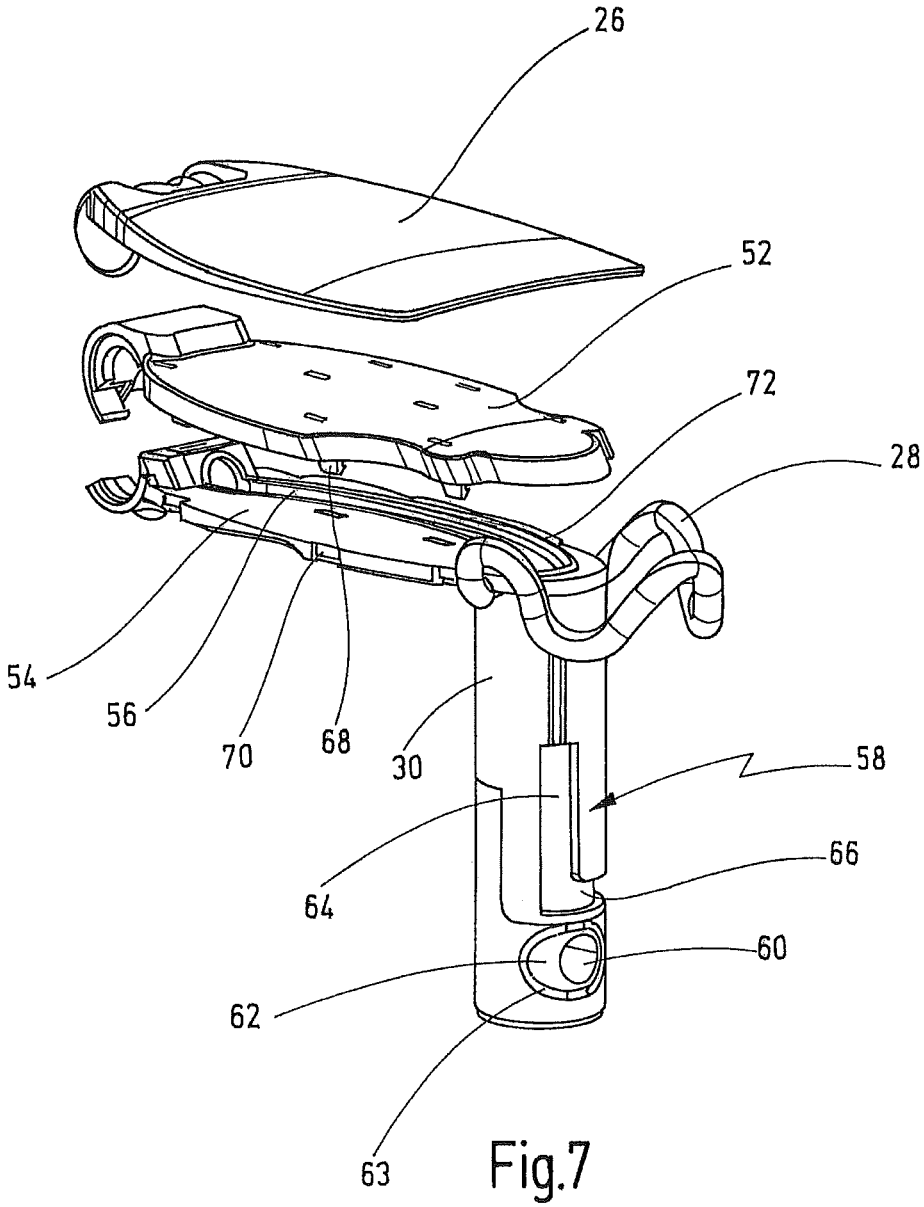
FIG. 7 is an enlarged illustration of the piston with the lower part of the extension arm, the upper part arranged thereabove and the actuating member arranged thereabove.

FIG. 7 shows that the guide element 58 has an axial groove portion 64 and an adjoining peripheral groove portion 66 extending in the circumferential direction. At the handle 28, the piston 30 can therefore firstly be withdrawn upward along the axial groove portion 64 and be rotated by a certain amount on reaching its axial end position. This allows the piston 30 to be transferred from the position in which it is initially completely submerged in the sleeve 36 into the opened position in which the piston 30 juts out upwards and the extension arm 34 is pivoted outwards beyond the edge 25 of the container 10, thus allowing simple dispensing. The outlet channel 56, via which liquid can pass from the outlet opening 44 up to the dispensing valve 24 and finally up to the dispensing opening 48, is located in the extension arm 34 which is arranged at the upper end of the piston 30.

As may be seen in greater detail from FIGS. 6 and 7, the extension arm 34 is composed of two parts: of a lower part 54 and of an upper part 52. The lower part 54 and upper part 52 can be joined together securely and in a sealing manner, for example by latches 68 on the upper part 52 that engage with associated latching receptacles 70 on the lower part 54. The outlet channel 56 has a curved shape and is formed from two mutually complementary depressions formed in the upper part 52 and in the lower part 54. The depressions in question are sealed from each other by a peripheral sealing bead 72.

A two-part construction of this type of the extension arm 34 made up of two interconnectable parts allows both parts to be produced as injection-molded parts, while the outlet channel 56 can nevertheless have roughly a curved shape.

The curvature of the outlet channel 56 is advantageous, as this facilitates a lower overall height and accommodation of the dispensing device 22 in the closed position above the top 12. That is to say, as the top 12 is embodied so as to rise towards the filling opening 18, the curved design of the outlet channel 56 allows the outlet channel to be placed more into the outer region of the outwardly open recess 23 between the top 12 and outer edge 25. This saves overall height.

In the embodiment illustrated in this figure, the dispensing valve 24 is embodied as a roller valve (cf. FIG. 5), with a hollow space 50 which is connected to the outlet channel 56 via an inlet opening 51, and also with a dispensing opening 48 via which liquid can be dispensed when the dispensing valve 24 is opened. In this case, the inlet opening 51 is laterally offset from the dispensing opening 48.

In the closed position, in which the piston 30, in its position still completely retracted in the sleeve 36, is in the original state, liquid is additionally prevented from issuing via the inflow opening 40 also by a sealing face 62 which encloses the piston inlet 60 and is enclosed at its outer edge by a sealing bead 63 (cf. FIG. 7).

This additional sealing allows even elevated keg pressures, which can form during the storage and the transportation of containers filled with beer, for example, and which may be up to about 5 bar, to be safely accommodated without the risk of liquid seeping out.

Figure 8:
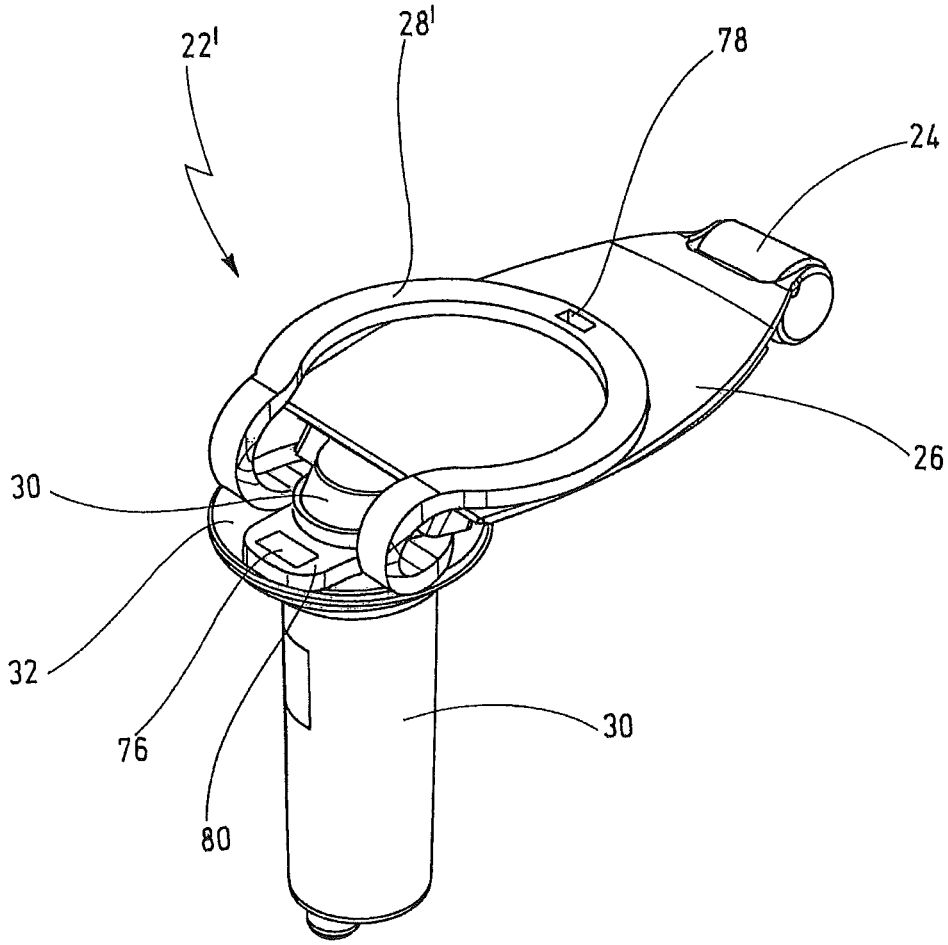
FIG. 8 is a slightly modified embodiment of the dispensing device according to the invention, the handle for actuating the piston having a slightly modified design and being embodied for a tamper-evident element.

In FIG. 8 a slightly modified embodiment of the dispensing device according to the invention is shown and denoted in its entirety by reference numeral 22'.

In this case, the handle 28' for withdrawing the piston 30 has a somewhat modified shape. This is a ring extending along the actuating member 26 on the upper side thereof. For activation, the handle 28' is pivoted outwards, the handle 28' rolling off on the surface of the sealing flange 32 with corresponding curvatures and thus raising the piston 30 upwards.

In addition, FIG. 8 also shows a tamper-evident element which is provided to make it visually discernible whether the dispensing device 22' has already been actuated and is thus no longer in its closed-off original state. For this purpose, a web 80, in which a recess 76 is provided, can for example be embodied at the upper end of the piston 30. A plastics material, which is connected to the surface of the sealing flange 32 located therebelow, can be injected through the recess 76. If the handle 28' is actuated, then the plastics material injected through the recess 76 becomes detached and thus indicates that the handle 28' is being actuated for the first time. Equally, a further recess 78, for example, through which a plastic strip or the like, which is connected to the actuating member 26, is molded on, can be provided at the outer end of the handle. In this case too, tearing-off indicates actuation for the first time.

What is claimed is:

1. A liquid dispensing system, comprising:

a container having a top, a bottom and a side wall, thereby defining a hollow interior, said side wall having an outer edge projecting over said top, said top and said outer edge defining an outwardly open recess;

a sleeve which can be sealingly inserted into said top of said container, said sleeve comprising a connection element to which a rising pipe can be connected, and an inflow opening;

a piston movably arranged in said sleeve and axially movable between a retracted position and an extended position, said piston comprising a cavity, a piston inlet opening and an outlet opening, said cavity connecting said piston inlet opening and said outlet opening, said piston further comprising a guide element extending axially and circumferentially on an outer surface of said piston, said piston having an inner end received within said sleeve and having an outer end protruding from said sleeve;

an extension arm connected at one end to the outer end of the piston so as to laterally project from said piston, said extension arm comprising a dispensing opening adjacent its other end and an outlet channel, said outlet channel connecting said outlet opening with said dispensing opening, said extension arm being movable between a closed position and a use position in which said dispensing opening extends beyond said outer edge;

a dispensing valve provided on said extension arm operatingly connected with said dispensing opening and said outlet channel;

an actuating member provided on said extension arm which is adapted to activate said dispensing valve; and a handle provided on said piston and being configured for moving said piston relative to said sleeve;

wherein said extension arm is arranged for being completely recessed in said outwardly open recess in said closed position and can be moved into said use position when said piston is in said extended position, and further wherein said extension arm rotates said piston into a dispensing position when moved from said closed position to said use position;

wherein said guide element defines a path along which said piston can be moved relative to said sleeve thereby defining said extended position, said retracted position and said dispensing position; and wherein said dispensing valve can be activated selectively by said actuating member so as to enable liquid to be dispensed from said dispensing opening or to prevent liquid from flowing off via said dispensing opening, when said extension arm is in said use position.

2. The liquid dispensing system of claim 1, wherein said extension arm is comprised of two parts which can be securely connected to each other and are provided with joining faces facing mutually, and with depressions which jointly form said outlet channel.

3. The liquid dispensing system of claim 2, further comprising sealing elements arranged for sealing said joining faces against each other.

4. The liquid dispensing system of claim 1, further comprising a tamper-evident element indicating whether said dispensing system is in a still intact original state, said tamper-evident element comprising a tear-off plastic web or a tear-off plastic tab.

5. A dispensing device for dispensing liquid from a container top surface, comprising:

a sleeve which can be sealingly inserted into said top surface, said sleeve comprising a connection element to which a rising pipe can be connected, and an inflow opening;

a piston movably arranged in said sleeve and axially movable between a retracted position and an extended position, said piston comprising a cavity, a piston inlet opening and an outlet opening, said cavity connecting said piston inlet opening and said outlet opening, said piston having an inner end received within said sleeve and having an outer end protruding from said sleeve;

an extension arm connected at one end to the outer end of the piston so as to laterally project from said piston, said extension arm comprising a dispensing opening adjacent its other end and an outlet channel, said outlet channel connecting said outlet opening with said dispensing opening;

a dispensing valve provided on said extension arm and being operatingly connected with said dispensing opening and said outlet channel;

an actuating member which is adapted to activate said dispensing valve; and a handle provided on said piston and being configured for moving said piston relative to said sleeve;

wherein said extension arm is movable between a closed position and a use position and is arranged for being completely recessed in a recess on said container top surface in said closed position and can be moved into said use position when said piston is in said extended position, and further wherein movement of said extension arm from said closed position to said use position pivots said piston into a dispensing position in which said dispensing opening extends laterally beyond said top surface; and wherein said dispensing valve can be activated selectively by said actuating member so as to enable liquid to be dispensed from said dispensing opening or to prevent liquid from flowing off via said dispensing opening, when said extension arm is in said use position.

6. The dispensing device of claim 5, wherein said piston comprises a guide element extending axially and circumferentially on an outer surface of said piston, and wherein said guide element defines a path along which said piston can be moved relative to said sleeve, thereby defining said retracted position, said extended position and said dispensing position.

7. The dispensing device of claim 6, wherein said sleeve comprises an inwardly protruding counter-guide element arranged for cooperating with said guide element, thereby guiding said piston during movement along said path.

8. The dispensing device of claim 5, wherein said extension arm is comprised of two parts which can be securely connected to each other and are provided with joining faces facing mutually, and with depressions which jointly form said outlet channel.

9. The dispensing device of claim 8, further comprising sealing elements arranged for sealing said joining faces from each other.

10. The dispensing device of claim 5, further comprising a tamper-evident element indicating whether said dispensing system is in a still intact original state, said tamper-evident element comprising a tear-off plastic web or a tear-off plastic tab.

11. The dispensing device of claim 5, wherein said dispensing device is made of plastic injection-molded parts.

12. The dispensing device of claim 11, wherein a sealing face is provided between said piston and said sleeve, said sealing face being molded using two-component technology.

13. The dispensing device of claim 5, wherein said outlet channel comprises a restriction zone arranged for limiting an exit speed of liquid to be dispensed.

14. A dispensing device for dispensing liquid, comprising:

a sleeve arranged for being sealingly inserted into a top of a container, said sleeve comprising a connection element to which a rising pipe can be connected, and an inflow opening;

a piston movably arranged in said sleeve and axially movable between a retracted position and an extended position, said piston comprising a cavity, a piston inlet opening, and an outlet opening, said cavity connecting said piston inlet opening and said outlet opening, said piston having an inner end received within said sleeve and having an outer end protruding from said sleeve;

an extension arm connected at one end to the outer end of the piston so as to laterally project from said piston, said extension arm comprising a dispensing opening adjacent its other end and an outlet channel, said outlet channel connecting said outlet opening with said dispensing opening;

a dispensing valve provided on said extension arm and being operatingly connected with said dispensing opening and said outlet channel; and an actuating member which is arranged for activating said dispensing valve;

wherein said extension arm is movable between a closed position and a use position and is arranged for being completely recessed in a recess provided on said top of said container in said closed position, and can be moved into said use position when said piston is in said extended position, and further wherein said dispensing opening extends beyond a top edge of said container when said extension arm is in said use position; and wherein said dispensing valve can be activated selectively by said actuating member so as to enable liquid to be dispensed from said dispensing opening or to prevent liquid from flowing off via said dispensing opening, when said extension arm is in said use position.

15. The dispensing device of claim 14, wherein said piston is rotated into a dispensing position when said extension arm is moved from said closed position to said use position, and further wherein said piston further comprises a guide element defining a path along which said piston can be moved relative to said sleeve, thereby defining said extended position, said retracted position and said dispensing position, and wherein said sleeve comprises a counter-guide element, said guide element and said counter-guide element being arranged for cooperating, thereby guiding said piston during movement along said path.

16. The dispensing device of claim 15, wherein said piston further comprises a handle being configured for moving said piston between said retracted position and said extended position.

17. The dispensing device of claim 14, further comprising a tamper-evident element indicating whether said dispensing system is in a still intact original state, said tamper-evident element comprising a tear-off plastic web or a tear-off plastic tab.

18. The dispensing device of claim 14, wherein a sealing face is provided between said piston and said sleeve, said sealing face being molded using two-component technology.

19. The liquid dispensing system of claim 1, wherein the outer end of the piston is within said outwardly open recess below said outer edge when the piston is in said retracted position.

20. The dispensing device of claim 5, wherein the outer end of the piston is within said recess on said container top surface when the piston is in said retracted position.

* * * * *